US009676226B2

(12) United States Patent
Wu

(10) Patent No.: US 9,676,226 B2
(45) Date of Patent: Jun. 13, 2017

(54) ENERGY-STORAGE PEN IMPLEMENT SHARPENER

(71) Applicant: Chun-Hung Wu, New Taipei (TW)

(72) Inventor: Chun-Hung Wu, New Taipei (TW)

( * ) Notice: Subject to any disclaimer, the term of this patent is extended or adjusted under 35 U.S.C. 154(b) by 712 days.

(21) Appl. No.: 14/230,605

(22) Filed: Mar. 31, 2014

(65) Prior Publication Data

US 2014/0209211 A1 Jul. 31, 2014

(30) Foreign Application Priority Data

Apr. 12, 2013 (TW) ..... 102206753 U

(51) Int. Cl.
*B43L 23/00* (2006.01)
*B43L 23/02* (2006.01)

(52) U.S. Cl.
CPC ..... *B43L 23/008* (2013.01); *B43L 23/00* (2013.01); *B43L 23/02* (2013.01)

(58) Field of Classification Search
CPC ..... B43L 23/00; B43L 23/004; B43L 23/006; B43L 23/008; B43L 23/02; B43L 23/04; B43L 23/06; B43L 23/08; B43L 23/085
See application file for complete search history.

(56) References Cited

U.S. PATENT DOCUMENTS

| | | | | |
|---|---|---|---|---|
| 1,905,608 | A | 4/1933 | Schoenfeldt | |
| 2,505,452 | A | 4/1950 | Wimmer | |
| 2,995,112 | A | 8/1961 | Calhoun | |
| 3,237,607 | A * | 3/1966 | O'Brien | B43L 23/00 144/28.71 |

* cited by examiner

*Primary Examiner* — Matthew G Katcoff
(74) *Attorney, Agent, or Firm* — Muncy, Geissler, Olds & Lowe, P.C.

(57) ABSTRACT

An energy-storage pen implement includes a base, a spiral knife assembly, a rotating plate, an elastic device and a pressing block. The base includes a first groove and a second groove, and the first groove is provided for inserting a pen implement. The spiral knife assembly is disposed at the first groove. The rotating plate is disposed at the first groove and connected to the spiral knife assembly. The elastic device is disposed at the second groove. One end of the pressing block is connected to the rotating plate, and another end of the pressing block is connected to the elastic device. When the elastic device moves resiliently to push the pressing block, the pressing block drives the rotating plate and the spiral knife assembly to rotate, thereby allowing the spiral knife to sharpen the tip of the pen implement.

10 Claims, 11 Drawing Sheets

ENERGY-STORAGE PEN IMPLEMENT SHARPENER

CROSS-REFERENCES TO RELATED APPLICATIONS

This non-provisional application claims priority under 35 U.S.C. §119(a) on Patent Application No. 102206753 filed in Taiwan, R.O.C. on 2013 Apr. 12, the entire contents of which are hereby incorporated by reference,

BACKGROUND

Technical Field

The disclosure relates to a pen implement sharpener, and particularly to an energy-storage pen implement sharpener.

Related Art

The pencil is a tool for writing, noting or drawing and accompanies with most people's childhoods, and daily life. The tip of the pencil should be maintained in a proper conical shape, so as to expose the graphite core of the pencil for writing. Consequently, after using for a period, the tip of the pencil must be sharpened by a pencil sharpener or other tools.

A conventional pencil sharpener is operated manually to sharpen the pencil inserted therein through manually rotating a tilted sharpening blade thereof. When the rotation of the tilted sharpening blade is terminated, the tilted sharpening blade stops sharpening the pencil.

A conventional electric pencil sharpener is driven by a motor to sharpen the pencil. However, a battery or mains supply electricity are necessary to drive the conventional electric pencil sharpener.

The user must to rotate the operating bar to rotate the tilted sharpening blade repeatedly during applying the conventional pencil sharpener to sharpen the pencil. Additionally, upon operating the conventional electric pencil sharpener, electric power is essential, therefore, rising an energy wasting issue and even an environmental concern. Therefore, how to improve the additional functions of a pen implement sharpener is an urgent issue to be solved by the inventor of the disclosure and related personnel.

SUMMARY

In view of this, the disclosure provides a pen implement sharpener to solve the problems met in the prior arts.

One invention concept of the disclosure provides an energy-storage pen implement including a base, a spiral knife assembly, a rotating plate, an elastic device and a pressing block. The base includes a first groove and a second groove, and the first groove is provided for inserting a pen implement. The spiral knife assembly is disposed at the first groove. The rotating plate is disposed at the first groove and connected to the spiral knife assembly. The elastic device is disposed at the second groove. One end of the pressing block is connected to the rotating plate, and another end of the pressing block is connected to the elastic device. When the elastic device extends to push the pressing block back, the pressing block drives the rotating plate and the spiral knife assembly to rotate, thereby the spiral knife sharpening the tip of the pen implement.

As described, the disclosure provides a pen implement sharpener which is energy-saving, one-hand operable and has features for preventing user injury during operation. The pressing block is pressed manually, so that the compression of the pressing block turns into the mechanical force to drive the spiral knife assembly to sharpen the pen implement, so that the sharpening of the pen implement can be easily achieved by simply pressing the pressing block downwardly; in addition, the protecting cover and the inclined abutting member shields the inserting hole when the pen implement sharpener is not in use and provide a safety feature for preventing the user from touching the spiral knife assembly intentionally.

The detailed features and advantages of the disclosure are described below in great detail. through the following embodiments, the content of the detailed description is sufficient for those skilled in the art to understand the technical content of the disclosure and to implement the disclosure there accordingly. Based on the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein.

DETAILED DESCRIPTION

Figure 1:
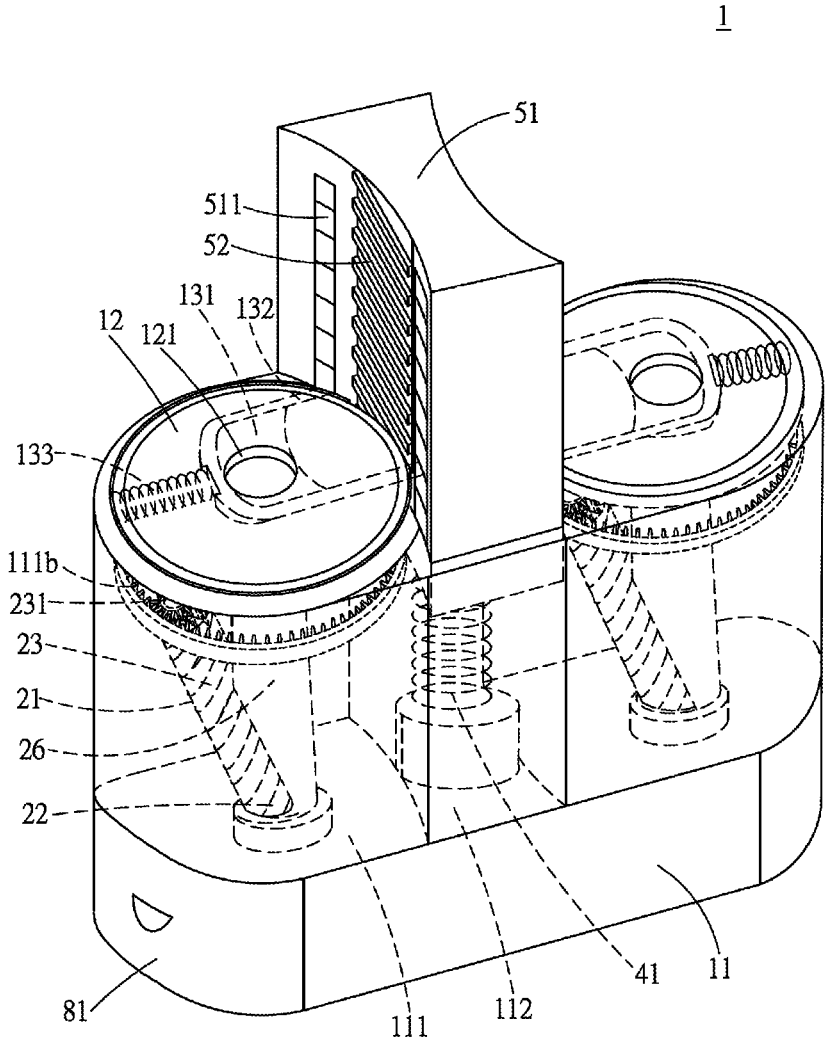
FIG. 1 is a perspective view of an energy-storage pen implement sharpener of one embodiment of the disclosure.
Figure 2:
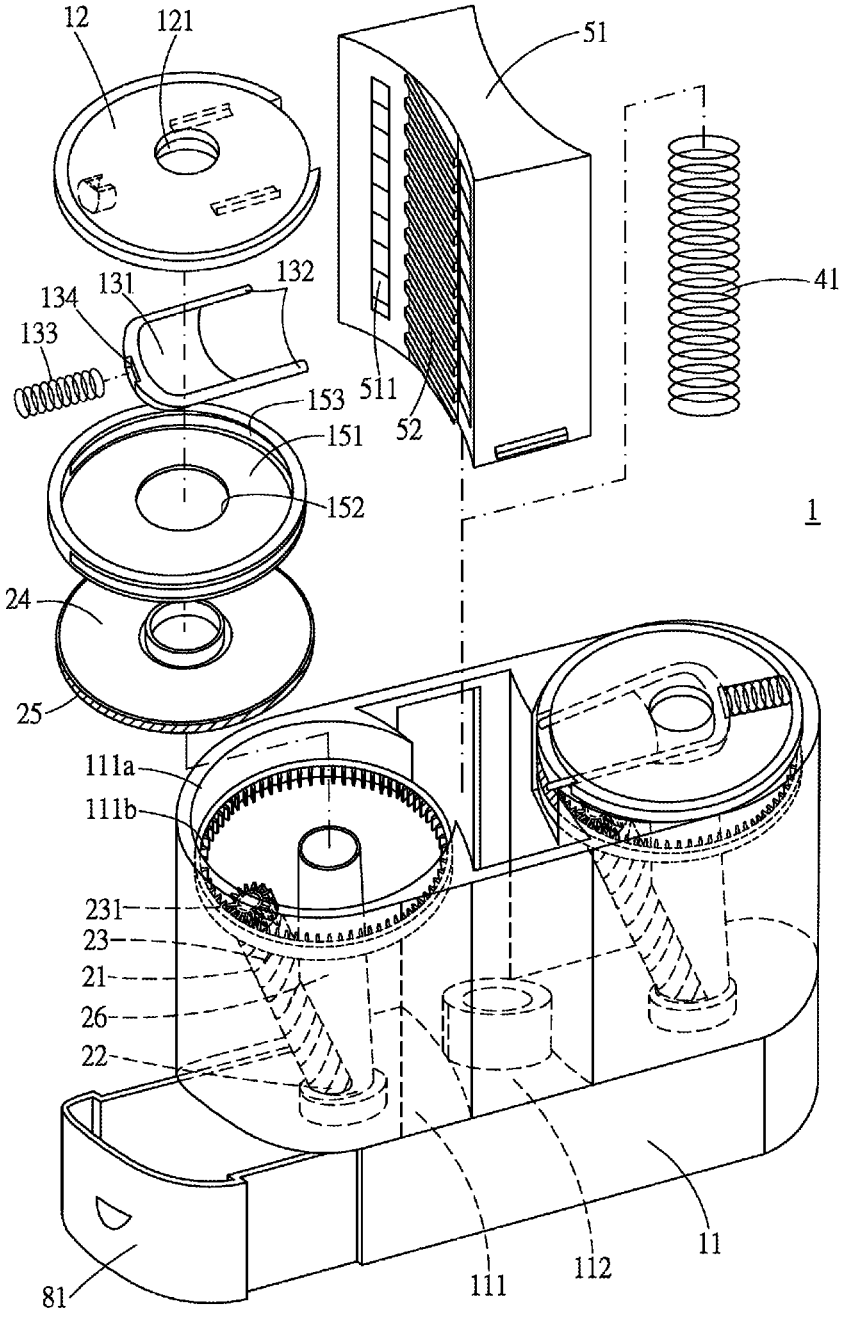
FIG. 2 is an exploded view of the energy-storage pen implement sharpener of one embodiment of the disclosure.
Figure 3:
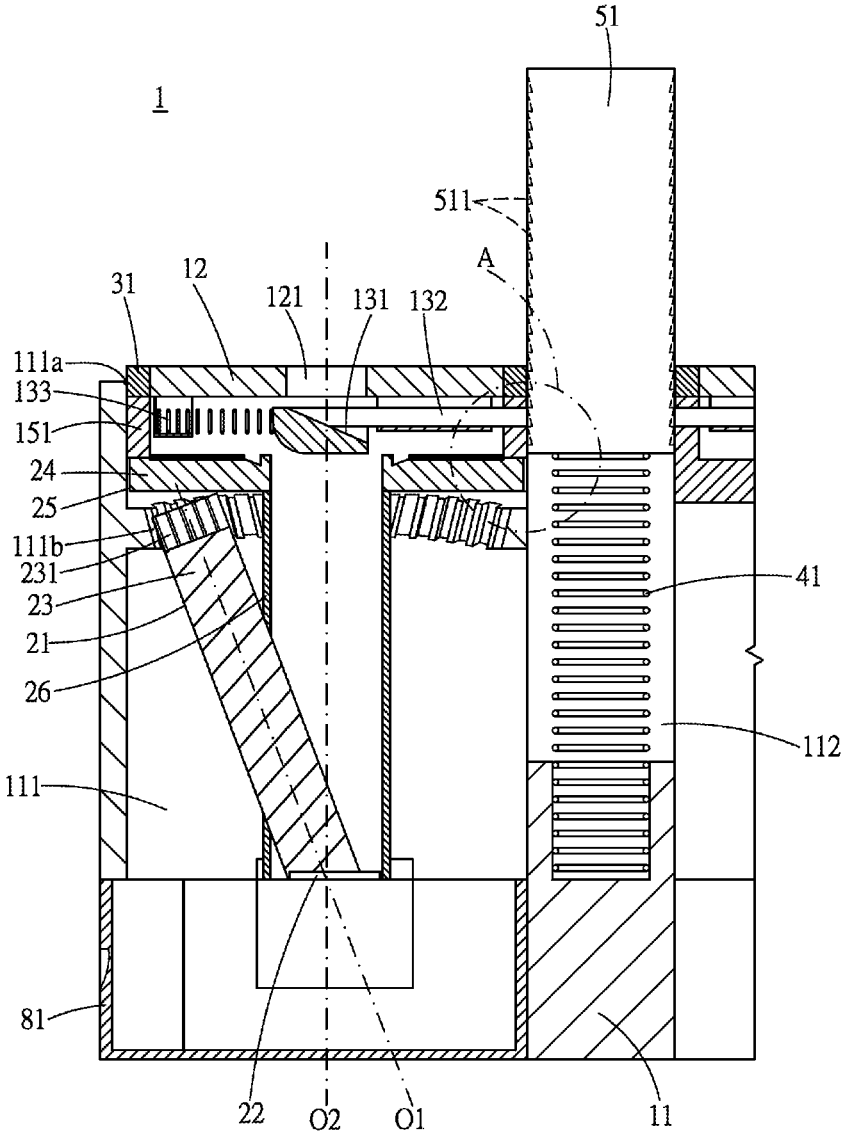
FIG. 3 is a lateral cross-sectional view of the energy-storage pen implement sharpener of one embodiment of the disclosure.

FIG. 1, FIG. 2 and FIG. 3, show one embodiment of the pen implement sharpener 1. Here, the pen implement sharpener 1 substantially includes a base 11, a spiral knife assembly 21, a rotating plate 24, an elastic device 41 and a pressing block 51. As shown in FIGS. 1-3, the pen implement sharpener 1 is a standing apparatus provided for vertically inserting a pen implement 91 to shaven the pen implement 91. Here, the pen implement 91 is a pencil, but embodiments are not limited thereto.

Figure 6:
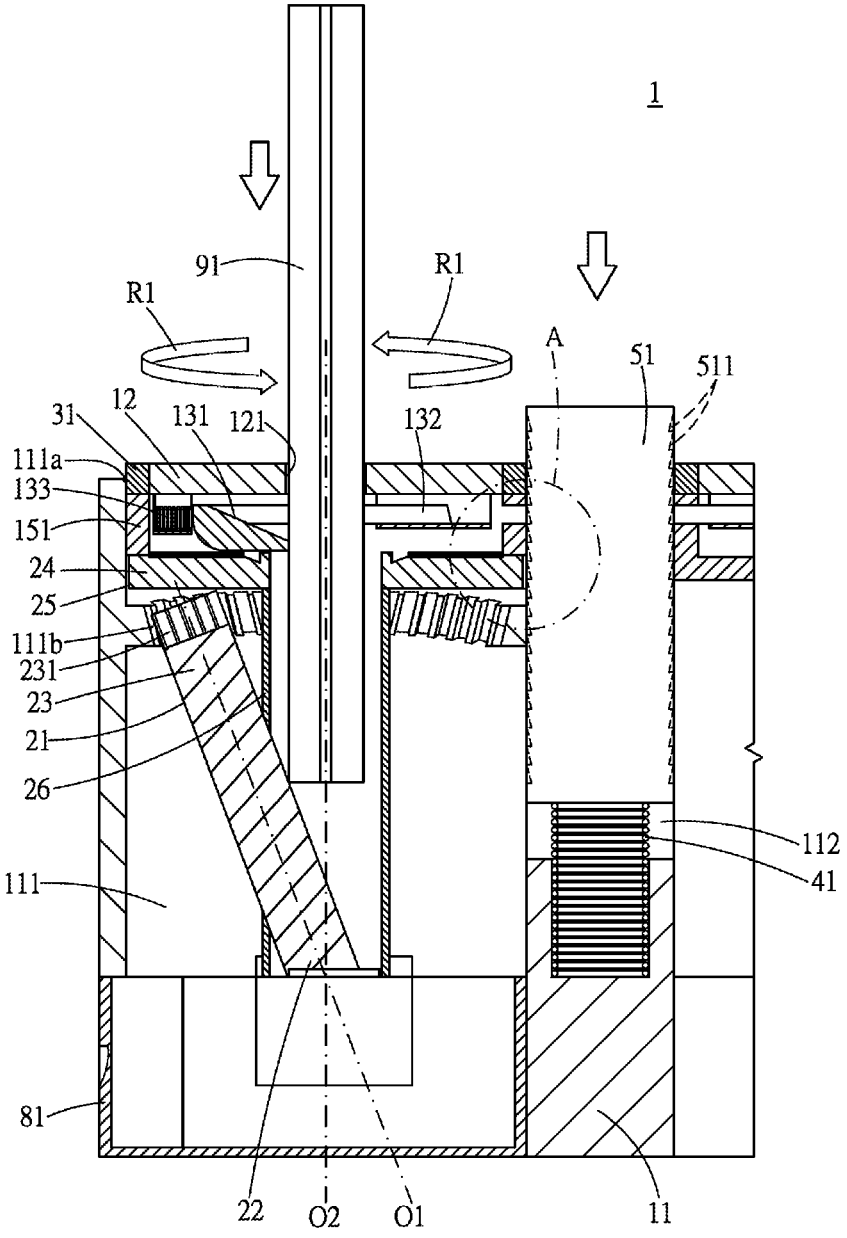
FIG. 6 is a schematic operational view (1) of the energy-storage pen implement sharpener of one embodiment of the disclosure.

Please refer to FIG. 2, in which the base 11 is a platform in a standing manner and includes at least a first groove 111 and at least a second groove 112 recessed on the upper portion thereof. Here, the figures show that one second groove 112 is vertically and inwardly recessed at the middle of the base 11, and two first grooves 111 are recessed vertically at two ends of the second groove 112, in which the outline of the first groove 111 is cylindered, but embodiments are not limited thereto; in some implementation aspects, the base 11 includes one first groove 111 and one second groove 112. In this embodiment, the first groove 111 is provided for vertically inserting the pen implement 91 (as shown in FIG. 6).

Please refer to FIG. 2, in which embodiment the first groove 111 has an opening 111*a* and an inner gear 111*b*. Here, the opening 111*a* is disposed at the top of the first groove 111, the inner gear 111*b* is annularly disposed around the inner wall of the first groove 111, the space between the opening 111*a* and the inner gear 111*b* is provided for disposing an inclined abutting member 131, a separating plate 151 and the rotating plate 24.

In this embodiment, the pen implement sharpener 1 further has a protecting cover 12, the inclined abutting member 131 and a latch 132. Here, the protecting cover 12 is disposed at the first groove 111 (namely, the protecting cover 12 covers the opening 111*a*). An inserting hole 121 is opened on the central portion of the protecting cover 12 and provided for inserting the pen implement 91. In this embodiment, the inclined abutting member 131 is disposed at the first groove 111, connected to the protecting cover 12 and located in the inserting hole 121 (as shown in FIG. 3). Here, the protecting cover 12 has a plurality of fastening members disposed at the bottom thereof and provided for fastening the inclined abutting member 131 and the latch 132. Furthermore, the inclined portion of the inclined abutting member 131 faces toward the inserting hole 121. Here, upon locating at a preset position, the inclined abutting member 131 covers the inserting hole 121.

Please refer to FIG. 2, in which the latch 132 is connected to two ends of the inclined abutting member 131 and is extended from the inclined abutting member 131. Here, the latch 132 and the inclined abutting member 131 are formed integrally as a whole. Additionally, in this embodiment, the first groove 111 further has a spring 133, and one end of the spring 133 is connected to the inclined abutting member 131. Here, the inclined abutting member 131 has an engaging groove 132 provided for limiting the spring 133. Another end of the spring 133 is connected to the fastening members. The spring 133 is provided for driving the inclined abutting member 131 move back resiliently, so that the inclined abutting member 131 shields the inserting hole 121.

Figure 5:
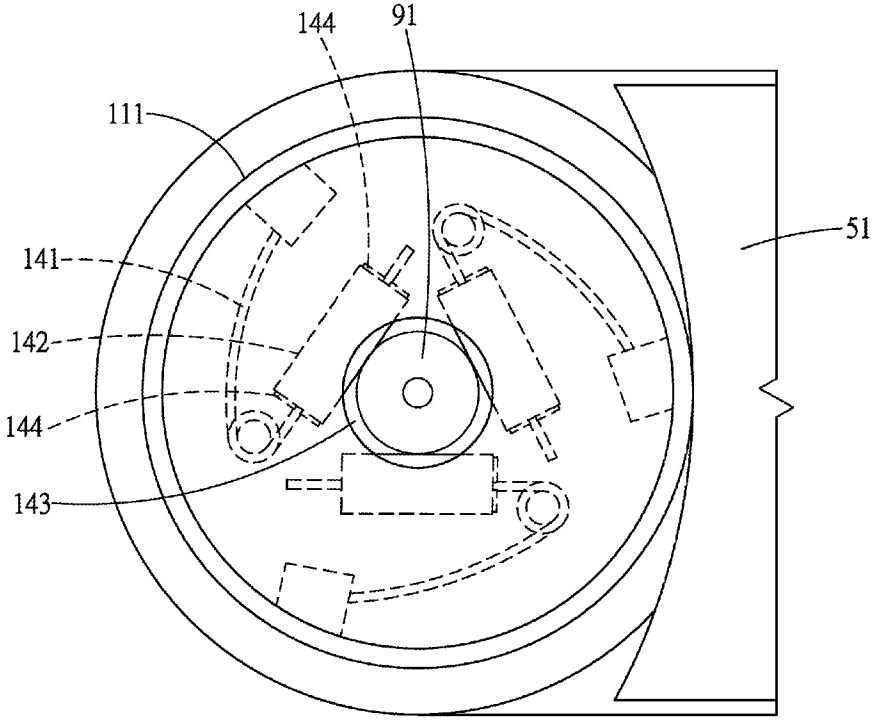
FIG. 5 is a partial top view of the energy-storage pen implement sharpener of one embodiment of the disclosure.

Please refer to FIG, 5, in which in some implementation aspects, the first groove 111 further includes a plurality of torsion springs 141, a plurality of pulleys 142 and a plurality of baffle plates 144 disposed thereon. In FIG. 5, the inclined abutting member 131 and the latch 132 are omitted so as to show the torsion springs 141, the pulleys 142 and the baffle plates 144 clearly. As shown, three torsion springs 141 are annularly aligned in the first groove 111, but embodiments are not limited thereto; in some implementation aspects, two torsion springs 141 are aligned in the first groove 111 so as to clamp two sides of the pen implement 91 (not shown).

In this implementation aspect, one end of each torsion spring 141 is connected to the inner wall of the first groove 111 (namely, secured to the first groove 111), another end of each torsion spring 141 is sleeved with each corresponding pulley 142 (namely, moveable relative to the first groove 111). Each pulley 142 has two baffle plates 144 sleeved on two sides thereof. Here, a clamping opening 143 is formed between the three pulleys 142 and corresponds to the periphery of the pen implement 91; namely, the size of the clamping opening 143 is smaller than the cross sectional area of the pen implement 91. In this embodiment, the baffle plates 144 are disposed at the two ends of the pulleys 142 for stopping the pulleys 142 from rolling (as shown in FIG. 5).

Consequently, when the pen implement 91 is inserted into the first groove 111, the pulleys 142 are elastically abutted against the outer surface of the pen implement 91 and position the pen implement 91 with different diameters, Here, the pen implement 91 having a rounded cross sectional projection is abutted against and fastened with the pulleys 142, but embodiments are not limited thereto; in some implementation aspects, the cross sectional projection of the pen implement 91 is polygonal.

Please refer to FIGS. 2-3, in which embodiment the pen implement sharpener 1 has a separating plate 151 disposed in the first groove 111. The separating plate 151 is disposed at a lower position opposite to the protecting cover 12, and the inclined abutting member 131 is disposed between the separating plate 151 and the protecting cover 12. Here, a through hole 152 is opened on the separating plate 151 (that is, a hole providing for passing through the pen implement 91), and is disposed at a center portion of the separating plate 151. In this embodiment, the separating plate 151 further has a trough 153 disposed at the periphery of the separating plate 151 and provided for passing through the latch 132.

Please refer to FIG. 2 and FIG. 6, in which when the pen implement 91 abuts the inclined abutting member 131, the latch 132 and the pressing block 51 are separated, so that the pen implement 91 is downwardly inserted into the first groove 111 to abut against the spiral knife assembly 21. At this moment, if the pressing block 51 is released, the pressing block 51 will be pushed by the elastic device 41 so as to move upward resiliently.

Figure 7:
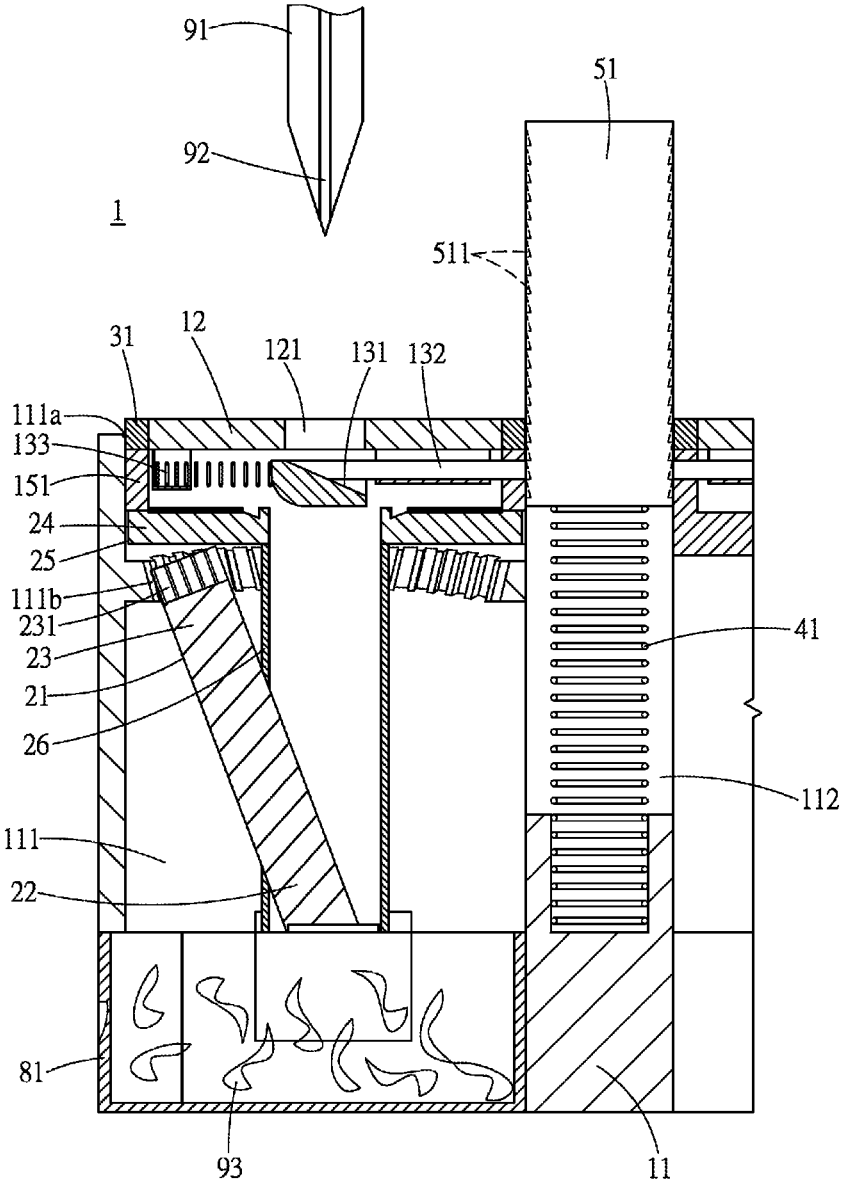
FIG. 7 is a schematic operational view (2) of the energy-storage pen implement sharpener of one embodiment of the disclosure.

Please refer to FIG. 7, in which when the pen implement 91 is detached from the inclined abutting member 131, the inclined abutting member 131 is pushed by the spring 133 and moves to shield the inserting hole 121, so that the inserting hole 121 is not exposed when the pen implement sharpener 1 is not in use. Furthermore, when the inclined abutting member 131 is moved resiliently, the inclined abutting member 131 drives the latch 132 to connect to the pressing block 51; meanwhile, the latch 132 positions the pressing block 51.

Please refer to FIG. 1, FIG. 2 and FIG. 3, in which embodiment the spiral knife assembly 21 is disposed inside the first groove 111. Here, the spiral knife assembly 21 includes a guiding tube 26 and a sharpening knife 23. One end of the guiding tube 26 is connected to the rotating plate 24, and another end of the guiding tube 26 includes a shaft portion 22 disposed in the first groove 111. One end of the sharpening knife 23 is connected to the shaft portion 22, and another end of the sharpening knife 23 has a small gear 231 engaged with the inner gear 111*b*.

Figure 3A:
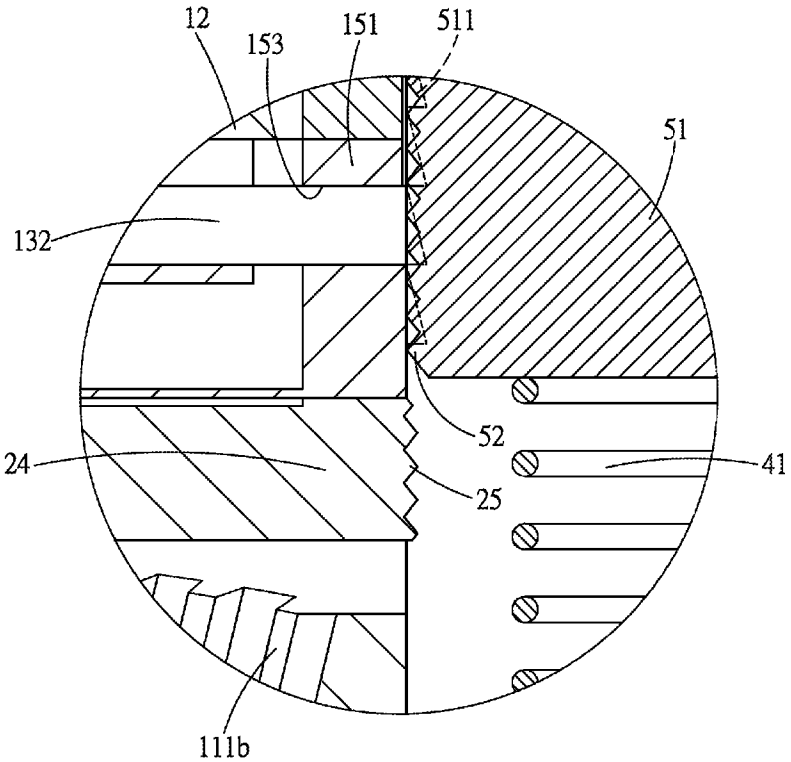
FIG. 3A is a schematic partial enlarged view of the A portion shown in FIG. 3.
Figure 6A:
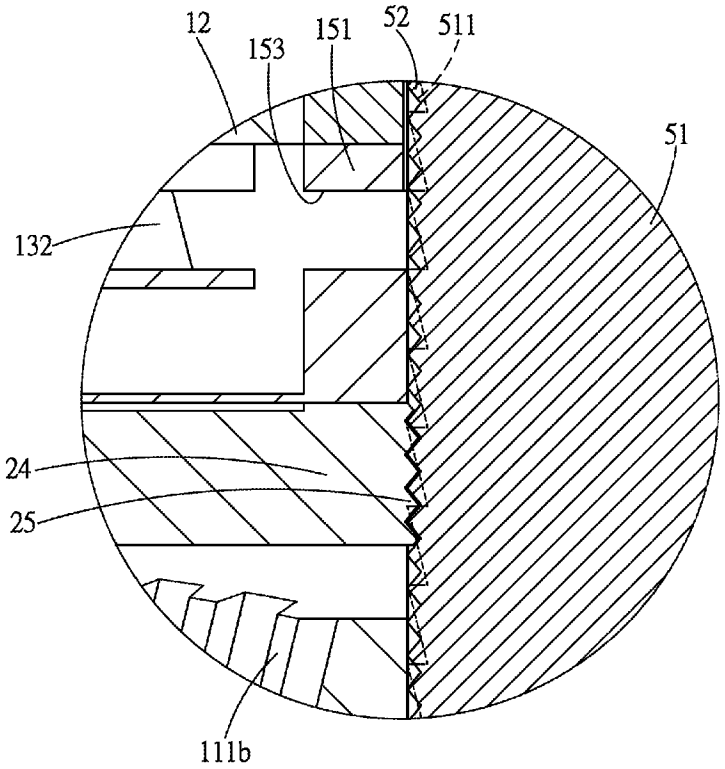
FIG. 6A is a schematic partial enlarged view of the A portion shown in FIG. 6.

Please refer to FIG. 1, FIG. 2 and FIG. 3, in which embodiment the rotating plate 24 is disposed above the spiral knife assembly 23 and disposed between the inner gear 111*b* and the separating plate 151. The rotating plate 24 has a plurality of second tilted gears 25 annularly disposed around the outer periphery thereof; that is, the rotating plate 24 has teeth disposed tilted around the periphery thereof, and the teeth are connected to a first tilted gear 52 of the pressing block 51, so that the first tilted gear 52 drives the second tilted gears 25 to rotate the rotating plate 24 (as shown in FIG. 3A and FIG. 6A), thereby driving the spiral knife assembly 21 to rotate.

During the rotation of the spiral knife assembly 24, the sharpening knife 21 is rotating along with the rotation of the guiding tube 26; at this moment, since the small gear 231 of the sharpening knife 23 is engaged with the inner gear 111 b, the sharpening knife 23 is rotated using the shaft portion 22 as the rotating center, and the small gear 231 is rotated along the inner gear 111*b,* thereby the sharpening knife 23 rotating with respect to the guiding tube 26 as well as rotating using the central axial line thereof. Here, another end of the sharpening knife 23 is connected to the shaft portion 22, and an inclined angle is formed between the central axial line O1 of the sharpening knife 23 and the central axial line O2 of the pen implement 91 (as shown in FIG. 6).

Figure 8:
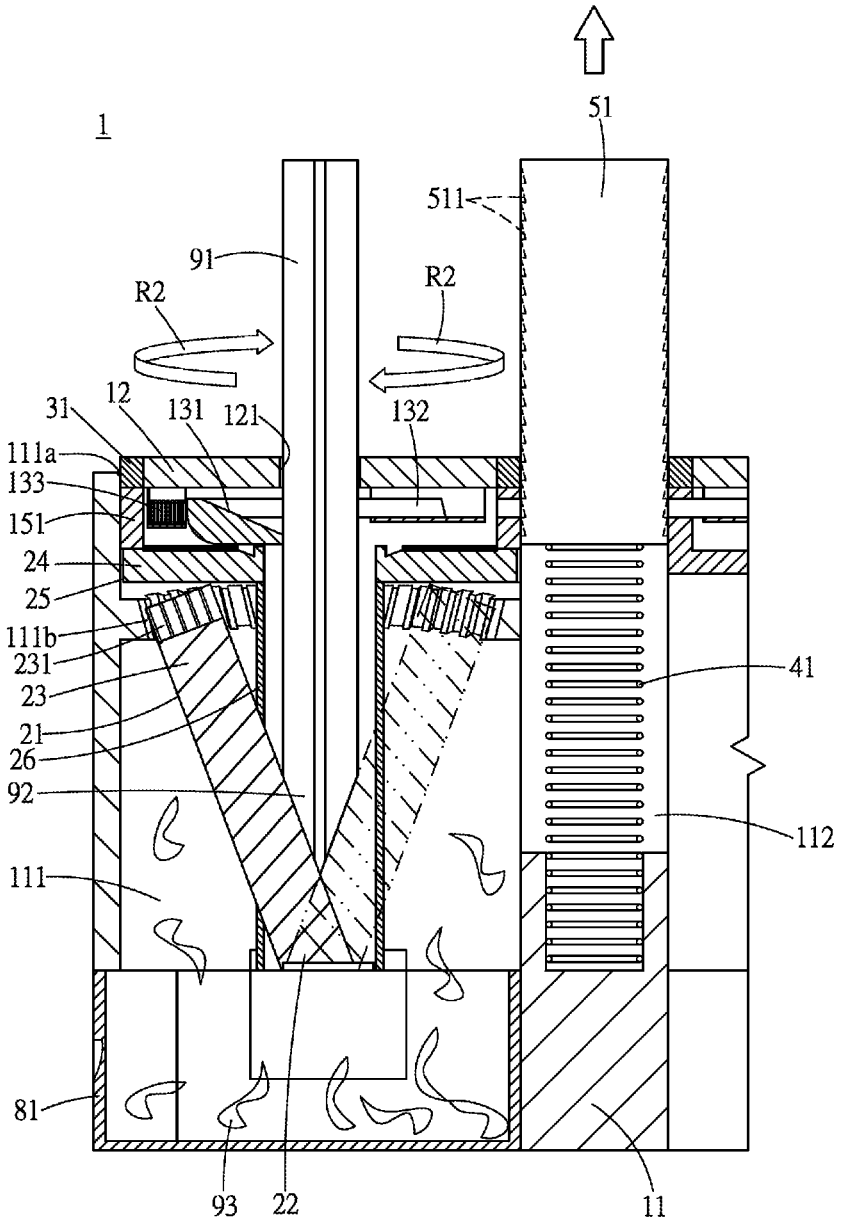
FIG. 8 is a schematic operational view (3) of the energy-storage pen implement sharpener of one embodiment of the disclosure.

Please refer to FIG. 8, in which when the sharpening knife 23 is rotated using the shaft portion 22 as the rotating axis, the sharpening knife 23 sharpens and rubs the pen implement 91, so that the crumbs 93 of the tip 92 of the pen implement 91 are detached from the pen implement 91. Here, the crumbs 93 are detached from the sharpening knife 23 through centrifugal force.

Please refer to FIG. 2 and FIG. 7, in which embodiment the first groove 111 has a crumb collecting box 81 connected thereto. When the crumbs 93 are fallen into the crumb collecting box 81, the crumbs 93 can be removed by taking out the crumb collecting box 81 from the lateral of the base 11.

Please refer to FIGS. 1-2, in which embodiment the elastic device 41 is disposed at the second groove 112. Here, the elastic device 41 is a compressive spring, one end thereof is abutted against the inner wall of the second groove 112, and another end thereof is abutted against the pressing block 51.

Here, the elastic device 41 is a compressive spring, but embodiments are not limited thereto; in some implementation aspects, the elastic device 41 is a stretchable spring, and two ends thereof are respectively fastened with the pressing block 51 and the inner wall of the second groove 112; moreover, in some implementation aspects, the elastic device 41 is a rubber; while in some implementation aspects, the second groove 112 includes a plurality of elastic devices 41 assembled therein.

Figure 4:
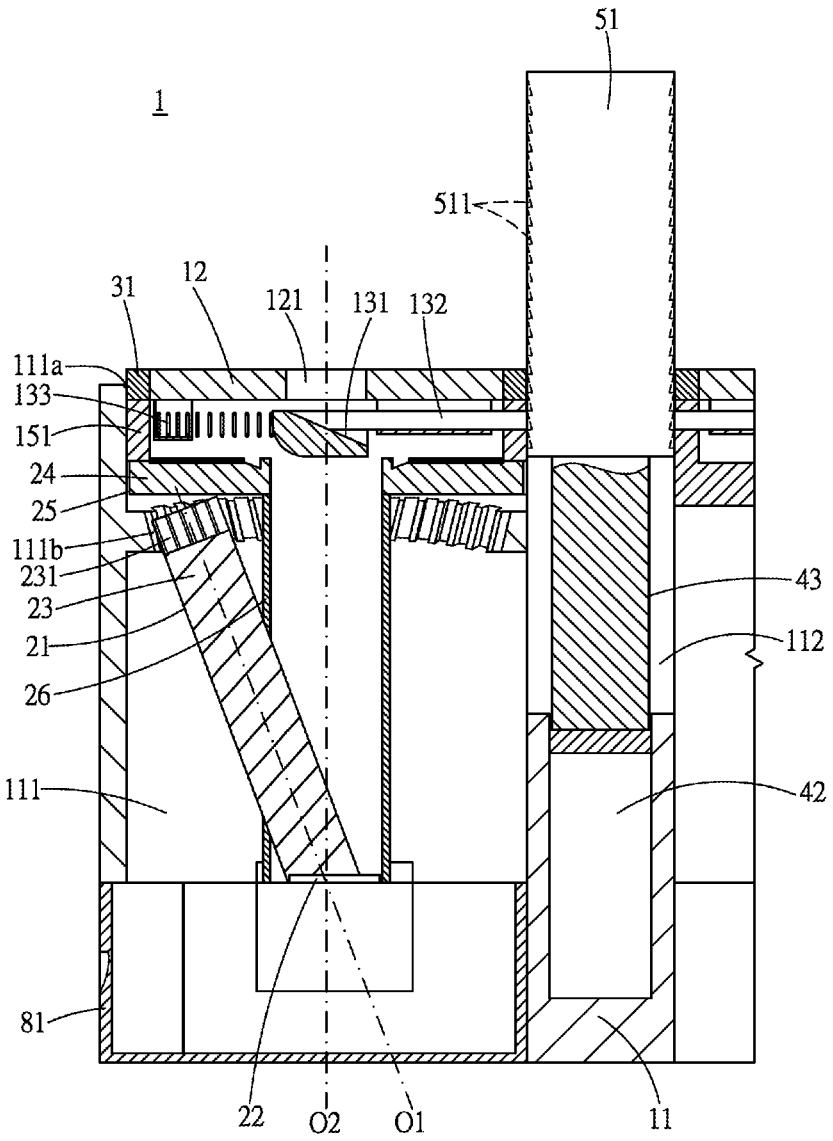
FIG. 4 is a lateral cross-sectional view of another implementation aspect of the elastic device of the energy-storage pen implement of the disclosure.

In some implementation aspects, as shown in FIG. 4, the elastic device 41 is a device generating force by compressing air. In which embodiment, the elastic device 41 includes a sealed groove 42 and a sealed block 43, and the sealed groove 42 is disposed in the second groove 112. One end of the sealed block 43 is connected to the sealed groove 42, and another end of the sealed block 43 is connected to the pressing block 51. When the pressing block 51 compresses the elastic device 41, the sealed block 43 compresses the air inside the sealed groove 42; while when the elastic device 42 extends to push the pressing block 51 back, the sealed block 43 does not compress the air inside the sealed groove 42; namely, the force applied by the air inside the sealed groove 42 moves the pressing block 51 resiliently.

Please refer to FIG, 1 and FIG. 2, in which the pressing block 51 is an elongated block; here, one end of the pressing block 51 is connected to the rotating plate 24, one face of the pressing block 51 has the first tilted gear 52 disposed thereon. The first tilted gear 52 is protruded out of the pressing block 51 and connected to the second tilted gears 25 of the rotating plate 24. Another end of the pressing block 51 is connected to the elastic device 41.

One face of the pressing block 51 has a plurality of inclined-opening groove 511 vertically aligned thereon and disposed beside the first tilted gear 52. Here, the cross sectional projection of the inclined-opening groove 511 is 1-profiled (as shown in FIG. 3A) so as to connect to and position the latch 132; that is, the inclined-opening groove 511 is provided for limiting the pressing block 51 from detaching from the second groove 112.

Figure 9:
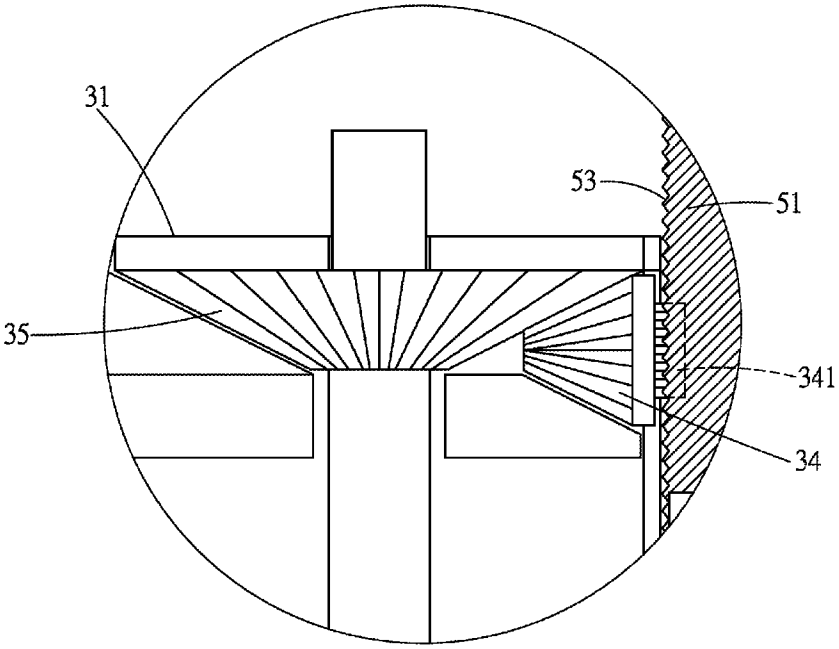
FIG. 9 is a schematic partial enlarged view of another implementation aspect of the transmission method of the energy-storage pen implement of the disclosure.

Here, the engagement between the rotating plate 24 and the pressing block 51 is provided via the engagement of the first tilted gear 52 and the second tilted gears 25, but embodiments are not limited thereto. Please refer to FIG. 9, in which in some implementation aspects, the pen implement sharpener 1 further includes a gear assembly 31 assembled in the first groove 111, and the gear assembly 31 includes a first conical gear 34 and a second conical gear 35 engageable with each other. Here, the pressing block 51 has a gear bar 53 assembled thereon. One end of the first conical gear 34 includes an engaging portion 341 connected to the gear bar 53, one end of the second conical gear 35 is connected to another end of the first conical gear 34, and another end of the second conical gear 35 is connected to the spiral knife assembly 21.

Please refer to FIG. 2 and FIG. 6, in which upon using the pen implement sharpener 1, the pressing block 51 is pressed into the base 11 firstly, so that the first groove 111 is ready for inserting the pen implement 91. Additionally, when the pressing block 51 compresses the elastic device 41, the pressing block 51 drives the rotating plate 24 and the spiral knife assembly 21 to rotate; here, the rotating plate 24 and the spiral knife assembly 21 rotate along a first rotating direction R1 (namely, the rotating plate 24 and the spiral knife assembly 21 rotate counterclockwise, as indicated in FIG. 6). After the pen implement 91 is inserted into the first groove 111, the pressing block 51 is released, and then the pressing block 51 is moved resiliently by the elastic device 42 to drive the rotating plate 24 and the spiral knife assembly 21 to rotate again; here, the rotating plate and the spiral knife assembly rotate along a second rotating direction (namely, the rotating plate 24 and the spiral knife assembly 21 rotate clockwise, as indicated in FIG. 8). Consequently, the spiral knife assembly 21 rotates with respect to the pen implement 91 and sharpens the inserting end of the pen implement 91 to form the tip 92.

The disclosure provides a pen implement sharpener 1 which is energy-saving, one-hand operable and has features for preventing user injury during operation. The pressing block 51 is pressed manually, so that the compression of the pressing block 51 turns into the mechanical force to drive the spiral knife assembly 21 to sharpen the pen implement 91, so that the sharpening of the pen implement 91 can be easily achieved by simply pressing the pressing block 51 downwardly; in addition, the protecting cover 12 and the inclined abutting member 131 shields the inserting hole 121 when the pen implement sharpener I is not in use and provide a safety feature for preventing the user from touching the spiral knife assembly 21 unintentionally.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A energy-storage pen implement sharpener, comprising:

a base, comprising a first groove and a second groove, the first groove being provided for inserting a pen implement;

a spiral knife assembly, disposed at the first groove;

a rotating plate, disposed at the first groove and connected to the spiral knife assembly;

an elastic device, disposed at the second groove; and a pressing block, one end thereof connecting to the rotating plate, another end thereof connecting to the elastic device, when the pressing block compresses the elastic device, the pressing block drives the rotating plate and the spiral knife assembly to rotate along a first rotating direction, when the elastic device extend to push the pressing block back, the pressing block drives the rotating plate and the spiral knife assembly to rotate along a second rotating direction, the spiral knife assembly is provided to sharpen the tip of the pen implement.

2. The energy-storage pen implement sharpener according to claim 1, further comprising:

a protecting cover, disposed at the first groove, comprising an inserting hole;

an inclined abutting member, disposed at the first groove and connected to the protecting cover; and a latch, disposed at the first groove and connected to the inclined abutting member, when the pen implement pushes the inclined abutting member, the latch is detached from the pressing block, when the pen implement is detached from the inclined abutting member, the latch is fastened with the pressing block.

3. The energy-storage pen implement sharpener according to claim 2, further comprising a separating plate disposed at the first groove, the separating plate is disposed at a lower position opposite to the protecting cover, and the inclined abutting member is disposed between the separating plate and the protecting cover.

4. The energy-storage pen implement sharpener according to claim 2, further comprising a spring connected to the inclined abutting member.

5. The energy-storage pen implement sharpener according to claim 2, wherein the pressing block comprises an inclined-opening groove connected to the latch.

6. The energy-storage pen implement sharpener according to claim 1, wherein the pressing block comprises a first tilted gear disposed at one face of the pressing block, the rotating plate comprises a second tilted gear connected to the first tilted gear.

7. The energy-storage pen implement sharpener according to claim 1, further comprising:

a plurality of torsion springs, disposed at the first groove, one ends of the torsion springs connecting to the inner wall of the first groove; and a plurality of pulleys, disposed at the first groove and connecting to another ends of the torsion springs, a clamping opening is formed between the pulleys provided for securing the pen implement.

8. The energy-storage pen implement sharpener according to claim 1, further comprising a gear set, the gear set comprises:

a first conical gear, comprising an engaging portion connecting to the pressing block; and a second conical gear, one end thereof is connected to the first conical gear, another end thereof is connected to the spiral knife assembly.

9. The energy-storage pen implement sharpener according to claim 1, wherein the spiral knife assembly comprises:

a guiding tube, connecting to the rotating plate and comprising a shaft portion disposed in the first groove; and a sharpening knife, one end thereof is connected to the shaft portion, another thereof has a small gear, the base comprises an inner gear engaged with the small gear, an inclined angle is formed between the central axial line of the sharpening knife and the central axial line of the pen implement, when the sharpening knife rotates by taking the shaft portion as the center, the crumbs of the tip of the pen implement are detached from the sharpening knife through centrifugal force.

10. The energy-storage pen implement sharpener according to claim 1, wherein the elastic device comprises:

a sealed groove; and a sealed block, one end thereof is connected to the sealed groove, another end thereof is connected to the pressing block, when the pressing block compresses the elastic device, the pressing block compresses the air inside the sealed groove, when the elastic device extends to push the pressing block back, the sealed block does not compress the air inside the sealed groove.

* * * * *